United States Patent [19]

Häggqvist

[11] 3,934,609

[45] Jan. 27, 1976

[54] CONTROL UNIT FOR CENTRAL HEATING SYSTEMS

[75] Inventor: Ulw Lars Anders Häggqvist, Vadstena, Sweden

[73] Assignee: Vadstena Pumpar AB, Vadstena, Sweden

[22] Filed: Sept. 16, 1974

[21] Appl. No.: 506,112

[30] Foreign Application Priority Data

Feb. 8, 1974 Sweden ..... 7401681

[52] U.S. Cl. ..... 137/565; 137/563; 137/597

[51] Int. Cl.[2] ..... F04B 21/02

[58] Field of Search ..... 137/563, 565, 569, 357, 137/359, 360, 597; 417/313

[56] References Cited

UNITED STATES PATENTS 2,861,364 11/1958 Klein ..... 137/563 X

FOREIGN PATENTS OR APPLICATIONS 2,178,378 9/1973 France 536,464 6/1973 Switzerland

*Primary Examiner*—William R. Cline

*Attorney, Agent, or Firm*—Laff, Whitesel & Rockman

[57] ABSTRACT

A control unit for central heating systems has a single integrally produced body with openings for connecting the unit to main and group distributing and return pipes. The unit has also mounted on its body a circulation pump, a throttle valve, a shunt valve and a check valve. Inside the body, there are channels for connecting in a prescribed way the pump, valves and openings.

1 Claim, 4 Drawing Figures

CONTROL UNIT FOR CENTRAL HEATING SYSTEMS

The present invention relates to a control unit for central heating systems.

It is an object of the invention to provide a unit which simplifies the installation of the heating system and which is of such a compact design that it requires only a small space. Also, to the service engineer the unit offers an advantage, since the different controls and the adjusting means are collected together in one and the same place.

According to the invention the unit comprises a single integrally produced body, provided with openings adapted to be connected to the main distributing and return pipes and to the group distributing and return pipes. It is further provided with a system of enclosed channels, a first one of which is connected, via a circulation pump secured on the unit, between the opening for the main distributing pipe and the opening for the group distributing pipe. A second one is connected, via in turn a throttle valve and a two-way or three-way shunt valve, between the opening for the group return pipe and the opening for the main return pipe. A third one is connected between the throttle valve and the shunt valve. A fourth one is connected, via a check valve, between the third channel and the suction side of the circulation pump.

Further features of the invention will become apparent from the following description of embodiments of the invention, given merely by way of example, in which.

Figure 1:
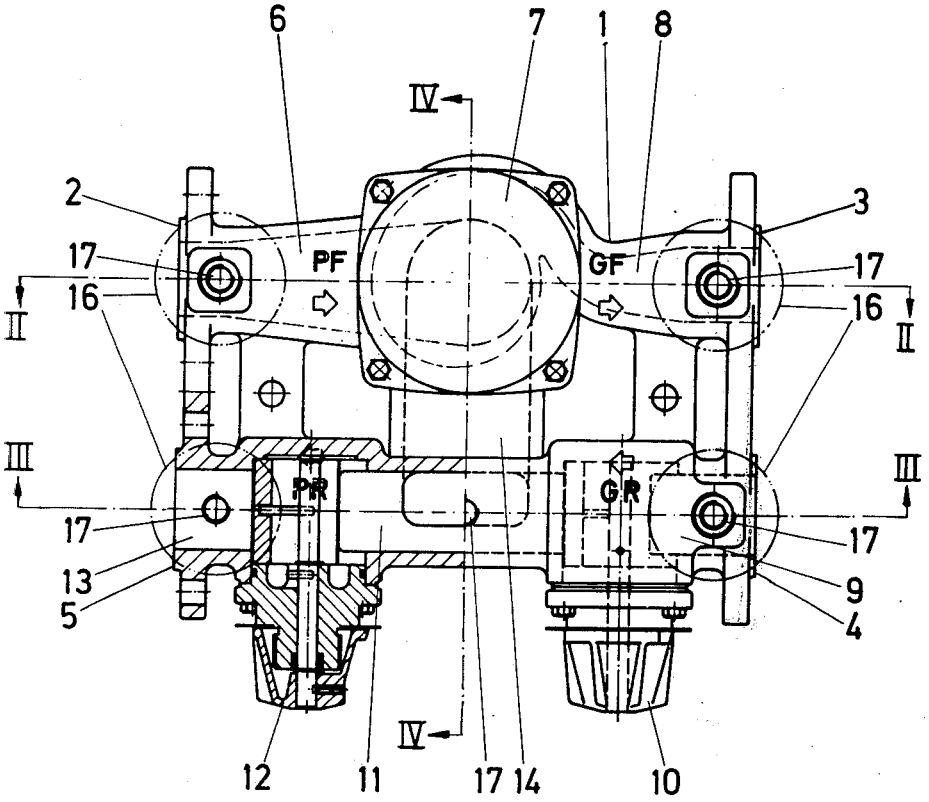
FIG. 1 is a front view of the control unit, partly in section.

In the drawing the numeral 1 designates a single integrally produced body, preferably made through a moulding process. This body is provided with flanges having openings 2, 3, 4 and 5. Of these, the opening 2 is adapted to be connected to the main distributing pipe, the opening 3 is adapted to be connected to the group distributing pipe, the opening 4 is adapted to be connected to the group return pipe, and the opening 5 is adapted to be connected to the main return pipe.

Figure 2:
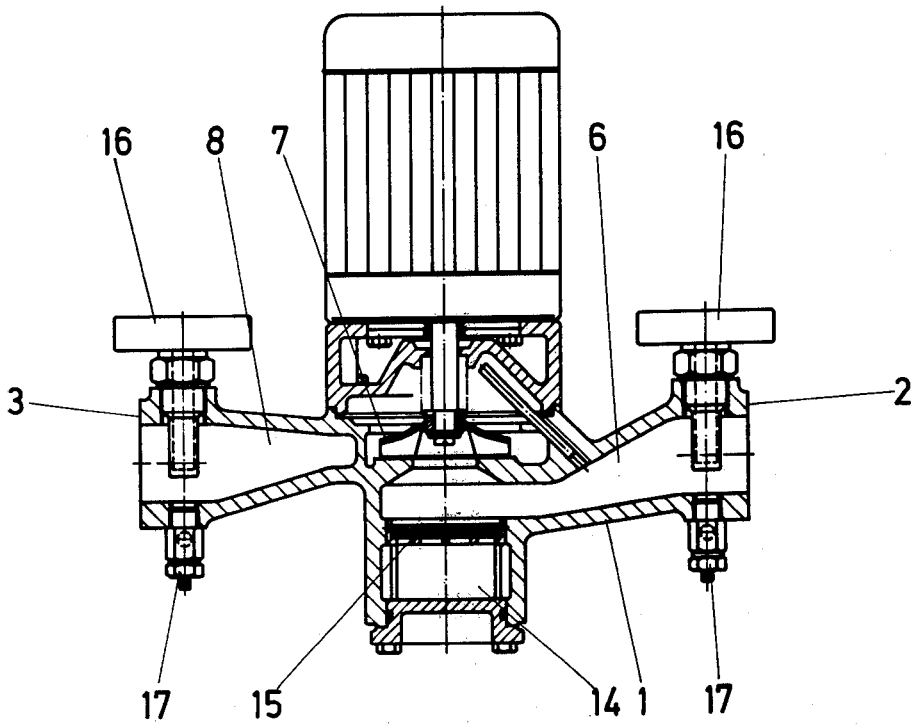
FIG. 2 is a sectional side elevation view taken in the direction of the arrows II—II in FIG. 1.
Figure 3:
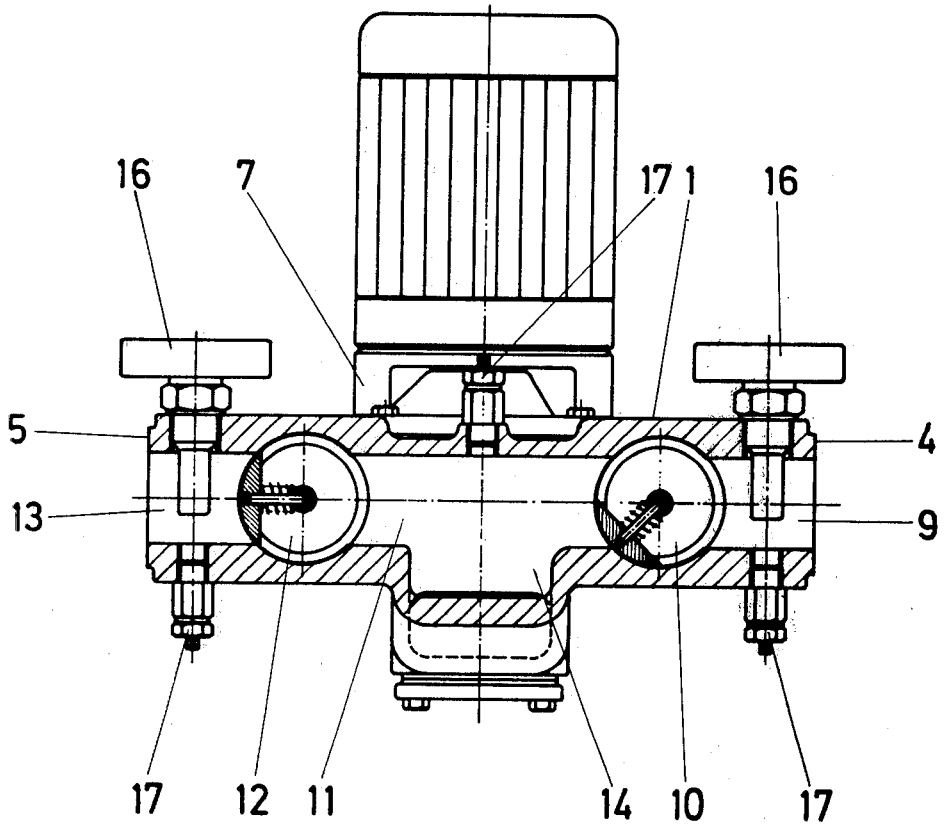
FIG. 3 is a sectional side elevation view taken in the direction of the arrows III—III in FIG. 1.

Enclosed, when producing the body, is a system of channels which are within the body. These channels interconnect the openings mentioned above. Mounted on the body are the elements which are required for the function of the central heating system. Thus, a channel 6 connects the opening 2 (see especially FIG. 2) to a circulation pump 7, secured to the body 1. This pump, in turn, is connected through a channel 8 to the opening 3. The opening 4 is connected through a channel 9 (see especially FIG. 3) to a throttle valve 10, by means of which the water quantity and pressure required for the group are adjusted. This throttle valve 10 is connected through a channel 11 to a two-way or three-way shunt valve 12 for shunting the return water, this shunt valve 12 in turn being connected through a channel 13 to the opening 5.

Figure 4:
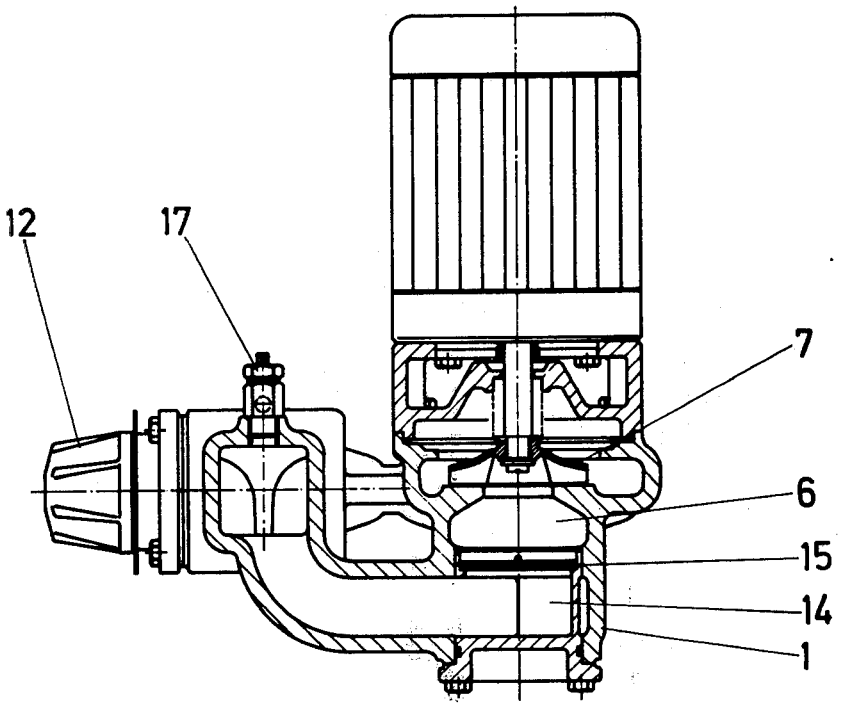
FIG. 4 is a sectional side elevation view taken in the direction of the arrows IV—IV in FIG. 1.

The channel 11 extends through, and communicates with a transverse channel 14 (see especially FIG. 2 and 4) connected to the channel 6, and thereby to the suction side of the circulation pump 7. In the connection between the channels 14 and 6 is inserted a check valve 15.

In the channels 6, 8, 9 and 13 of the body 1 are inserted thermometers 16 and measuring terminals 17. A further measuring terminal 17 is inserted in the channel 14.

As is evident from the above, the invention provides for a very robust control unit, comprising a single integrally produced body, onto which is mounted a circulation pump and also the adjusting and control means as required. Enclosed channels are used for interconnecting these elements and the openings which provide for making the connections of the necessary pipes. The channels formed when the body is produced. All parts are collected to a compact unit which considerably simplifies the installation of the heating system and its maintenance and service and at the same time requires a minimum of space where it is to be mounted.

I claim:

1. A control unit for central heating systems, said unit comprising a single integral body means, having therein a plurality of openings which are to be connected to main distributing and return pipes and to group distributing and return pipes, a system of enclosed channel means formed within said body, a circulation pump means, a throttle valve means, a shunt valve means and a check valve means associated with said body, a first one of said channel means connecting the opening for said main distributing pipe via said circulation pump means to the opening for said group distributing pipe, a second one of said channel means extending from the opening for said group return pipe through said throttle valve means, and said shunt valve means to the opening for said main return pipe, and a third of said channel means connecting said second channel means via said check valve means to the suction side of said circulation pump means.

* * * * *